US009776437B2

(12) United States Patent
Gracia Verdugo et al.

(10) Patent No.: US 9,776,437 B2
(45) Date of Patent: Oct. 3, 2017

(54) PRINTER ACCESSORY AND PRINTER

(71) Applicant: HEWLETT-PACKARD DEVELOPMENT COMPANY, L.P., Houston, TX (US)

(72) Inventors: Antonio Gracia Verdugo, Barcelona (ES); Sergi Culubret i Cortada, Barcelona (ES); Mauricio Seras Franzoso, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 28 days.

(21) Appl. No.: 14/916,258

(22) PCT Filed: Sep. 17, 2013

(86) PCT No.: PCT/EP2013/069279
§ 371 (c)(1),
(2) Date: Mar. 3, 2016

(87) PCT Pub. No.: WO2015/039680
PCT Pub. Date: Mar. 26, 2015

(65) Prior Publication Data

US 2016/0207334 A1 Jul. 21, 2016

(51) Int. Cl.

| | |
|---|---|
| ***B41F 15/02*** | (2006.01) |
| ***B41J 15/16*** | (2006.01) |
| ***B65H 75/10*** | (2006.01) |
| ***B65H 19/28*** | (2006.01) |
| ***B41J 15/02*** | (2006.01) |

(52) U.S. Cl.
CPC ..... *B41J 15/16* (2013.01); *B41J 15/02* (2013.01); *B65H 19/28* (2013.01); *B65H 75/10* (2013.01)

(58) Field of Classification Search
CPC . B41J 15/02; B41J 15/04; B41J 15/16; B65H 19/28; B65H 75/10
See application file for complete search history.

(56) References Cited

U.S. PATENT DOCUMENTS

| | | | |
|---|---|---|---|
| 3,934,840 A | 1/1976 | Inaga | |
| 5,071,501 A | 12/1991 | Doi et al. | |
| 5,248,107 A | 9/1993 | Sumida et al. | |

(Continued)

FOREIGN PATENT DOCUMENTS

| | | | |
|---|---|---|---|
| JP | 2013157349 | 8/2013 | |
| JP | 2013157349 A * | 8/2013 | ..... B65H 19/28 |

OTHER PUBLICATIONS

International Searching Authority. ISA/EP. dated Jul. 8, 2014. Application No. PCT/EP2013/089279. Filing date Sep. 17, 2013.

(Continued)

*Primary Examiner* — Jill Culler
*Assistant Examiner* — Marissa Ferguson Samreth
(74) *Attorney, Agent, or Firm* — HP Inc.-Patent Department

(57) ABSTRACT

According to one example there is provided an accessory for a printing system. The accessory comprises a cylindrical core on which a web of media may be wound, and a flexible sheet having a first end attached to the core and a second free end opposite the first end having a media connector attached thereto, the media connector to connect a free end of a web of media thereto.

19 Claims, 3 Drawing Sheets

(56) References Cited

U.S. PATENT DOCUMENTS

| | | | | |
|---|---|---|---|---|
| 5,875,989 | A | 3/1999 | Alexander | |
| 6,915,740 | B2 * | 7/2005 | Pozuelo | B41J 11/0045 101/227 |
| 2007/0059079 | A1 | 3/2007 | Silverbrook | |
| 2010/0163665 | A1 | 7/2010 | Gambini | |

OTHER PUBLICATIONS

Wickert, et al. A. Corrugation and Buckling Defects in Wound Rolls. Feb. 2006.

* cited by examiner

PRINTER ACCESSORY AND PRINTER

BACKGROUND

Many printing systems print on rolls or webs of media. Webs are often used for example, in high-volume printing systems, such as industrial printing systems, as they enable large volumes of printed content to be produced in an efficient manner.

The installation of a web into a printing system needs to be performed carefully and accurately to ensure that the web is carefully aligned.

BRIEF DESCRIPTION

Examples, or embodiments, of the invention will now be described, by way of non-limiting example only with reference to the accompanying drawings, in which.

DETAILED DESCRIPTION

When a new web is installed in a printing system the web typically has to be installed on a web support, which is often located at a rear side of the printing system. The free end of the web has to be manually fed through the media path of the printing system and attached to an empty take-up roll, which is often located at a front side of the printing system. Typically the take-up roll is simply a rigid cardboard cylinder.

Conventionally, the free end of the web has been attached to the take-up roll using sticky tape. However, it is difficult to ensure accurate alignment of the web on the take-up roll using this technique. Furthermore, if the take-up roll is located towards the base of the printing system the web installation operation becomes cumbersome for an operator to perform. Any misalignment in the installation of a web on a take-up roll can lead to print quality issues, damage to printed content, printing system malfunction, and other problems.

Figure 1:
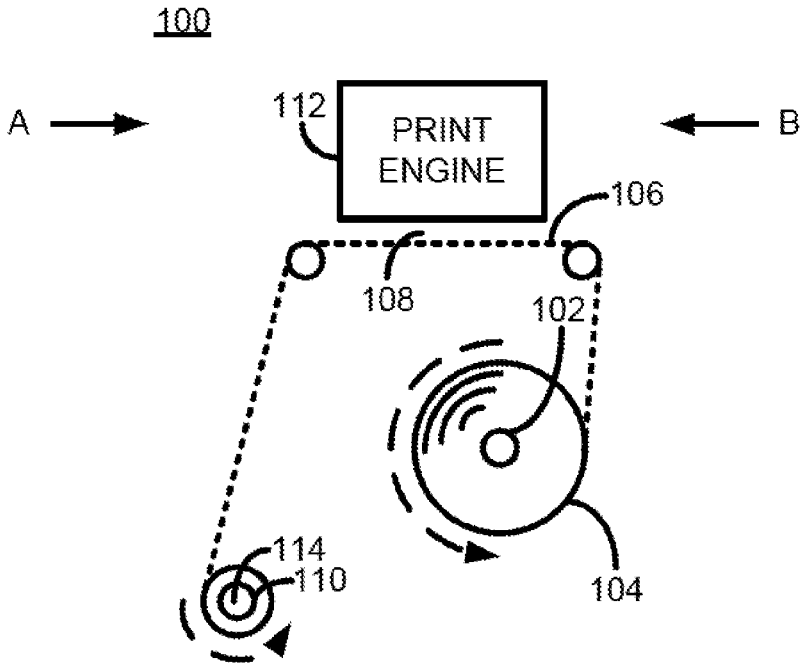
FIG. 1 is a simplified illustration showing a side-view of a printing system in which is installed a take-up roll according to one example.

Referring now to FIG. 1 there is shown a simplified illustration showing a side-view of a printing system 100 in which is used a take-up roll 110 according to one example. It will be understood that for reasons of clarity not all elements of a typical printing system are shown.

The printing system 100 has a front side indicated generally by 'A' and a rear side indicated generally by 'B'. Typically the front side would be the side of the printing system 100 that a user typically interacts with, for example where a display panel or printer control panel is located. The rear side would typically be the side of the printing system 100 that a user interacts with less frequently with, for example, when installing webs of media into the printing system.

The printing system 100 comprises a web support 102 onto which may be installed a web or roll of media 104. The web of media may be any suitable flexible media, such as paper, fabric, vinyl film, etc. The web of media 104 may be wound around a core (not shown), such as a rigid roll or tube. The web support 102 may be any suitable web support, such as a spindle onto which the web 104 is inserted, one or multiple support brackets, or the like. In some examples the web support 102 may be powered to enable the web 104 to be unwound or wound.

The printing system 100 comprises a media path indicated generally by a dotted line 106. The media path 106 is the path taken by media unwound from the web 104, through a print zone 108 and onto a take-up roll 110. The media path 106 may include one or multiple rollers, media guides, star wheels, belts, or other media moving or media positioning elements. It will be understood that in different examples the media path be substantially different from the simplified media path shown in FIG. 1.

A print engine 112 may print ink or other printing fluids on the media when in the print zone 108 to generate printed content on the media.

In the example shown the take-up roll 110 is installed on a take-up roll support 114. In one example the take-up roll support 114 is powered to drive media from the web 104, through the media path 106 and print zone 108 and to wind web on which printed content has been printed onto the take-up roll 110. In one example the take-up roll is cylindrical in shape as this helps ensures that the web is advanced at a constant speed through the media path during a printing operation.

When a new web 104 is installed in the printing system 100 the web 104 has to be installed on the web support 102, and the free end of the web has to be manually fed through the media path 106 and attached to the take-up roll 110.

Figure 2:
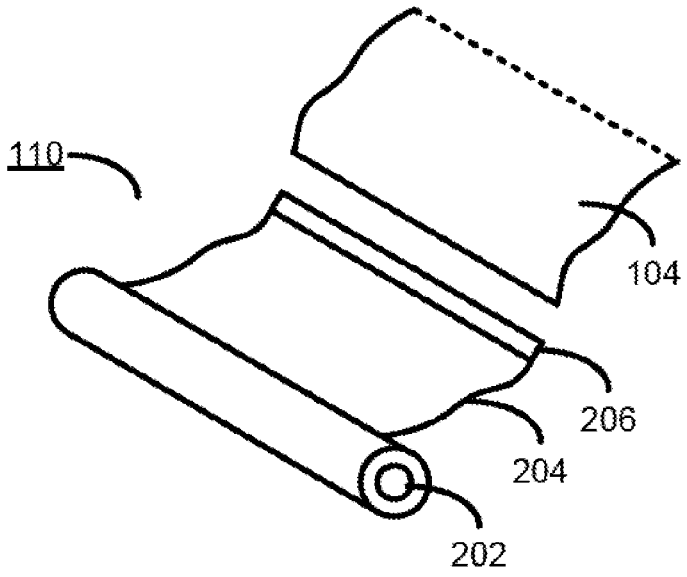
FIG. 2 is an illustration showing a more detailed view of a take-up roll according to one example.

FIG. 2 shows the take-up roll 110 according to one example in more detail. The take-up roll 110 comprises a rigid cylindrical core or tube 202 that may be installed on the web support 102. In one example the core 202 is hollow such that it may be installed on a web support in the form of a spindle. In another example the core 202 may have support elements at each extremity of the core 202 such that the core 202 may be installed on support brackets, or the like. In another example the core 202 may be solid. The core may be constructed of any suitable material including cardboard, metal, and plastic.

Attached to the core 202 is a flexible sheet 204. The flexible sheet 204 may be made of any suitable flexible material including paper, fabric, and plastic. In one example the sheet 204 has the same width as the width of the core 202. In other examples the sheet 204 has a width less than the width of the core 202. The flexible sheet 204 is accurately connected to the core 202 such that the lateral edges of the sheet are perpendicular to the core axis.

The free end of the sheet 204 has attached thereto a media connector shown generally in FIG. 2 as 206. The media connector 206 may take various different forms in different examples, as described below. The media connector 206 is accurately attached to the flexible sheet 204 such that when the flexible sheet is unwound and is held taught the axis of the media connector is parallel to the axis of the core 202.

Figure 3:
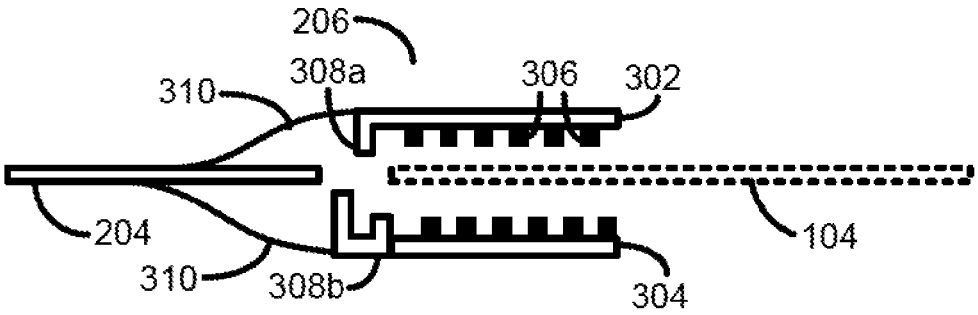
FIG. 3 is a side view of an example media connector according to one example.

An example media connector 206 is illustrated in FIG. 3. The media connector 206 comprises a pair of opposing mating elements 302 and 304 having a series of interlocking teeth or grippers 306. Each of the mating elements 302 and 304 are attached to the flexible sheet 204 by flexible connectors 310. In one example the body of each of the mating elements 302 and 304 are magnetic such that the two elements are held securely together by magnetic force when placed in close proximity to one another. In this manner, the free end of a web 104 (shown in dotted line in FIG. 3) may be inserted between the mating elements 302 and be securely attached thereto.

In a further example the mating elements 302 and 304 of the media connector may use a spring or similar resiliently-biased mechanism to securely attach the free end of a web.

In the example shown a pair of opposing alignment members 308*a* and 308*b* are, included in the connector 206 to provide a media alignment guide. The media alignment guide enables the free end of the web 104 (assuming the free end is accurately cut perpendicular to the edges of the web) to be accurately aligned in the media connector 206.

In one example the bodies of each of the mating elements 302 are flexible, or are substantially flexible, such that they may be wound around the core 202 without, or without unduly, deforming media 104 subsequently wound on the core 202.

In other examples other types of media connector may be used.

Once the free end of the web 104 has been accurately attached to the media connector 206 the take-up roll 110 may be rotated, for example under user control, to wind the flexible sheet 204 around the core 202. The take-up roll 110 may be further rotated such that the media connector 206 and the free end of the web 104 are also wound a number of times around the core 202. The web 104 is now fully installed in the printing system and may be used to have printed content produced thereon.

Figure 4:
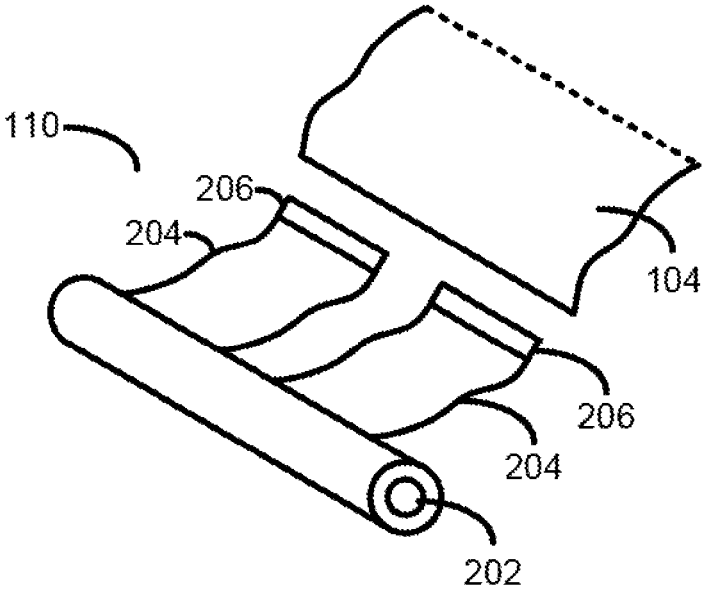
FIG. 4 is an illustration showing a more detailed view of a take-up roll according to one example.

In a yet further example, as shown in FIG. 4, multiple flexible sheets 204, each with an corresponding web connector 206, may be attached to the core 202. This may enable webs of different widths to be used with the core 202. For example, if a web 104 having the same or substantially the same width as the width of the core 202 is used then the web may be attached using all available media connectors. If, however, a web 104 having a width less than the width of the core 202 is to be used in the printing system only a single media connector may be used to secure the web 104 to the core 202.

Figure 5:
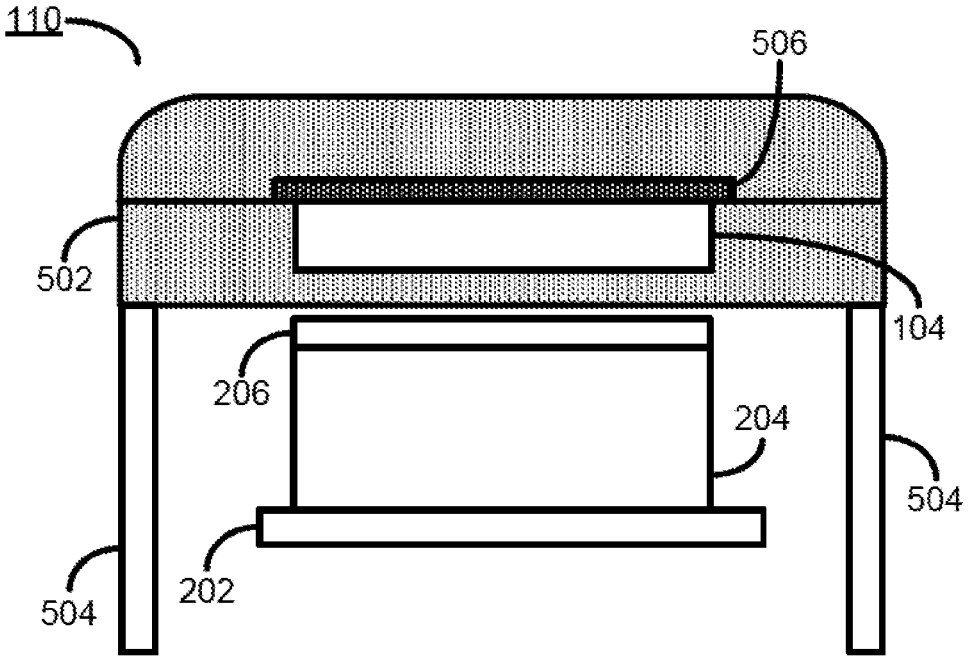
FIG. 5 is an illustration showing a simplified front view of a printing system according to one example.

Referring now to FIG. 5 there is shown a simplified front view of the printing system 100 of FIG. 1. For clarity, not all elements of a typical printing system are shown. The printing system 100 comprises a printer housing 502 supported by a printer stand 504. The height of the stand 504 is such that the printer can be comfortably operated by a user whilst in a standing position.

The free end of the web exits the printer housing 502 through a media output port 506, after having been fed from the web 104 (not shown in FIG. 5) and through the printer media path (not shown in FIG. 5).

In one example the length of the flexible sheet 204 of the take-up roll 202 is sufficient to allow an operator to bring, the media connection portion 206 at the free end of the flexible sheet 204 in close proximity to the media output port 506. In one example the length of the flexible sheet 204 is between about 1 and 2 meters in length, although in other examples a short or longer length may be chosen.

In this way, once an operator has fed web 104 through the media path and to the media output port 506 the operator may quickly and accurately connect the free end of the web 104 to the media connection portion 206 of the take-up roll. Advantageously, this enables the operator to connect the free end of the web 204 to the take-up roll whilst in a standing position making the web installation procedure considerably easier and more comfortable than previously possible. Furthermore, this helps reduce the likelihood of badly installing the web 104 and helps prevent web wastage and print quality problems.

Additionally, the take-up roll described herein helps reduce the amount of web wasted during web installation, since the media connector of the take-up roll can be brought up to the media output port, rather than the web having to be fed down to the take-up roll. In situations where expensive media is used or when webs are regularly swapped in a printing system such savings can be significant.

Once the web 104 has been completely wound onto the take-up roll 202 the web may be removed from the printing system. Once the web has been removed from the take-up roll 202 the take-up roll may be re-used in a printing system.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An accessory for a printing system, comprising:

a cylindrical core on which a web of media may be wound;

a flexible sheet having a first end attached to the core and a second, free end opposite the first end having a media connector attached thereto, the media connector to connect a free end of the web of media to the flexible sheet, the media connector including opposing alignment members to provide an alignment guide for the web of media without capturing the web of media therebetween.

2. The accessory of claim 1, wherein the flexible sheet has a width less than or equal to a width of the core.

3. The accessory of claim 1, further comprising a plurality of flexible sheets and corresponding media connectors spaced along the core.

4. The accessory of claim 1, wherein the accessory is to be installed as a take-up roll in a web-based printing system, and wherein a length of the flexible sheet is such that, when the accessory is installed in the printing system, the free end of the flexible sheet reaches or substantially reaches a media output port of the printing system.

5. The accessory of claim 1, wherein the flexible sheet is connected to the core such that lateral edges of the flexible sheet are perpendicular to an axis of the core.

6. The accessory of claim 1, wherein the media connector is flexible or is substantially flexible such that the media connector may be wound around the core without or without unduly deforming media subsequently wound onto the core.

7. The accessory of claim 1, wherein the media connector further includes opposing mating elements to grip the free end of the web of media therebetween.

8. The accessory of claim 7, wherein the media connector further includes flexible connectors extended from opposite sides of the flexible sheet to attach the opposing mating elements to the flexible sheet.

9. The accessory of claim 8, wherein the opposing alignment members extend toward each other from respective ones of the flexible connectors.

10. The accessory of claim 7, wherein the opposing mating elements include a plurality of interlocking teeth to grip the free end of the web of media therebetween.

11. The accessory of claim 7, wherein wherein the opposing mating elements are magnetic.

12. A printing system comprising:

a web support to receive a web of media;

a media path through which a free end of the web of media is to be fed;

a print engine for printing on the web of media;

a take-up roll to receive the free end of the web of media, the take-up roll comprising:

a flexible sheet having a first end attached to the take-up roll; and a media connector attached to a second end of the flexible sheet opposite the first end to receive the free end of the web of media, the media connector including opposing mating elements to grip the free end of the web of media therebetween and flexible connectors secured to and extended from opposite sides of the flexible sheet to attach a respective one of the mating elements to the flexible sheet.

13. The printing system of claim 12, wherein a length of the flexible sheet is such that, when unwound from the take-up roll, the media connector substantially reaches a media output port of the printing system.

14. The printing system of claim 12, wherein the media connector is flexible such that the media connector can be wound around the take-up roll.

15. The printing system of claim 12, wherein the opposing mating elements include a plurality of interlocking teeth to grip the free end of the web of media therebetween.

16. The printing system of claim 12, wherein the opposing mating elements are magnetically attracted to each other to secure the free end of the web of media using magnetic force.

17. The printing system of claim 12, wherein the take-up roll comprises a spaced plurality of flexible sheets and corresponding media connectors.

18. The printing system of claim 12, wherein the media connector further includes opposing alignment members which provide an alignment guide for the free end of the web of media without capturing the web of media therebetween.

19. The printing system of claim 18, wherein the opposing alignment members extend toward each other from respective ones of the flexible connectors.

* * * * *